United States Patent [19]
de Wit
[11] 4,230,237
[45] Oct. 28, 1980

[54] TABLET DISPENSER

[75] Inventor: Erik de Wit, Vienna, Austria
[73] Assignee: Hermes Süsstoff AG, Zurich, Switzerland

[21] Appl. No.: 962,689
[22] Filed: Nov. 21, 1978

[30] Foreign Application Priority Data

Nov. 28, 1977 [AT] Austria ..... 8508/77
Aug. 25, 1978 [AT] Austria ..... 6208/78

[51] Int. Cl.³ ..... B65D 83/04
[52] U.S. Cl. ..... 221/298; 206/534.2
[58] Field of Search ..... 221/251, 298, 263, 264; 206/540, 534.2; 414/126, 125

[56] References Cited

U.S. PATENT DOCUMENTS 3,042,256 7/1962 Sanner ..... 221/301
3,191,803 6/1965 Hamilton ..... 221/264 X

FOREIGN PATENT DOCUMENTS 1177072 4/1965 Fed. Rep. of Germany .
1062013 3/1967 United Kingdom .

*Primary Examiner*—F. J. Bartuska
*Attorney, Agent, or Firm*—Toren, McGeady and Stanger

[57] ABSTRACT

The feed duct of a tablet dispenser is formed with a movable wall portion which engages a tablet next adjacent the tablet being dispensed to prevent more than a single tablet from being dispensed at a time. A dispenser slide which opens and closes the discharge opening of the feed duct actuates displacement of the movable wall portion through an interposed spring member. Another movable wall portion of the feed duct located further upstream may operate in tandem with the first wall portion to block the feed duct and thereby prevent backward movement of tablets within the feed duct while the discharge opening is closed.

7 Claims, 1 Drawing Figure

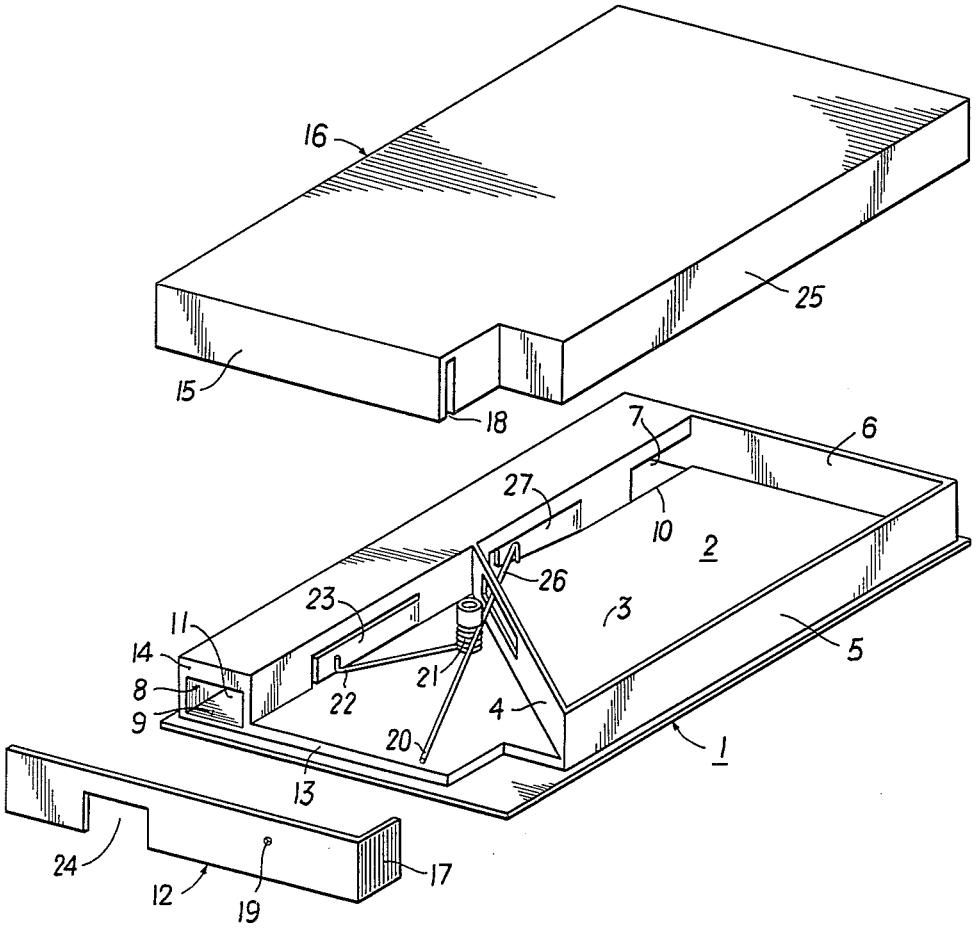
16
25
15
18
7
6
27
10
2
26
23
3
11
5
14
21
8
22
4
9
20
1
13
24
17
12
19

TABLET DISPENSER

The invention relates to a tablet dispenser having a charge opening which can be released temporarily and is connected to a feed duct whose cross-section is adjusted to the size of a tablet, and a clamping device for holding the second tablet in the feed duct while the first tablet is dispensed, the second tablet being located near the discharge opening.

In a tablet dispenser of this type previously known, the clamping device consists of a discharge cover which can be actuated against a force of a spring and which is provided with an opening which releases the opening of the discharge duct in an end position of the discharge cover. During the actuation of the discharge cover, a resilient stirrup acting against the spring force holds at least that tablet in the discharge duct which is located behind the tablet or tablets which are to be dispensed at this time, while the removal of the tablet or tablets lying in front of the stirrup is facilitated by means of gravity. However, in this case, the stirrup presses against the tablet to be clamped with its angular end in the manner of a knife, and the possibility that the tablet will be damaged cannot be excluded. In addition, to facilitate its operation, the discharge cover projects upwardly beyond the cover of the box-like tablet dispenser. As a result, these tablet dispensers cannot be conveniently stacked in large numbers thus causing problems with regard to their packing and transport.

Another disadvantage resides in that, during the manipulation of the dispenser, those tablets which are already in the discharge duct while a tablet is being dispensed can slide in a reversed direction and they frequently fall back into the supply chamber. As a result, the discharge duct will be inadequately charged with tablets when it is later desired to again dispense a tablet.

The present invention is directed toward overcoming these disadvantages. In the invention, this is accomplished by providing, at a predetermined distance from the discharge opening, clamping means in the form of a tongue which is formed from a lateral wall portion of the feed duct and which can be moved inwardly by a spring which is arranged in engagement between this tongue and a slide member which closes off the discharge opening and which is arranged in a side wall of the tablet dispenser. When this slide member is moved into the open position, the pressure of the spring against the tongue increases and the tongue is deformed so as to be moved into the discharge duct. The tablets can be prevented from sliding rearwardly in the discharge duct by a holding device arranged at a distance of several tablets upstream from the discharge opening, with this holding device being in its effective position when the discharge opening is closed. The holding device is connected to the slide member by means of a lever, bar, slide member or the like and reaches its ineffective position when the discharge opening is opened. It is advantageous to use a clamping device as holding device. However, it is also possible to use slide members which reach between adjacent tablets. An especially advantageous embodiment results when the closing device for the discharge opening is a slide member or the like which is arranged at the side wall of the tablet dispenser and acts through a spring arm on the end of a tongue which forms a wall portion of the discharge duct and which operates as the holding device.

The single figure of drawing is an exploded perspective view depicting a preferred embodiment of the invention.

With reference to the drawing, the bottom part of the tablet dispenser is in its totality denoted by reference numeral 1. This bottom part 1 has a supply chamber 2 which is formed by a bottom 3 and side walls 4, 5, 6. The fourth side of the supply chamber 2 is connected to a duct 8 through a small rectangular opening 7. The bottom 9 of the duct 8 leads to the bottom 3 of the supply chamber for the tablets through a step 10. The height of the opening 7 is chosen in such a way that the tablets can only pass through when they are lying flat on the bottom. The step 10 serves to prevent the tablets from sliding back from the duct 8 into the chamber 2. When the tablet dispenser is turned over, the tablets can still reach the supply chamber, even when the discharge duct has an additional step at the opening 7. The duct is provided with a discharge opening 11 which is closed off by the slide member 12. This slide member slides along a step 13 and a front wall 14 of the feed duct 8 and is guided by a wall 15 of the cover 16. The free end of the slide member which is provided with a gripping surface 17 emerges from the cover 16 through a slot 18. The slide member is provided with a bore 19. The end 20 of a hairpin spring 21 reaches into this bore 19. The other end 22 of the spring 21 bears against a tongue 23 which is formed a portion of the inner duct wall. The spring 21 holds the slide member 12 in its closed position in which the gripping surface 17 is in alignment with the wall 25 of the cover 16 or with the wall 5 of the bottom part 1.

In an inclined position, the tablets, not shown, slide through the opening 7 into the feed duct 8. When the tablets are in the feed duct 8, they slide toward the front of the dispenser until the first tablet makes contact with the slide member 12. When this tablet is to be dispensed, the gripping surface 17 is pressed, so that the slide member 12 moves until its recess 24 is in alignment with the discharge opening 11 of the feed duct 8 and a tablet is thus released. Simultaneously, this movement of the slide member 12 tensions the spring 21 and the spring 21 presses with its end 22 against the tongue 23 which holds, counted upstream from the discharge opening 11, the second tablet in the feed duct 8. After returning the slide member into its initial position, the load is taken off the tongue 23 and, thus, the row of tablets in the feed duct can advance toward the discharge opening 11.

At the hairpin spring 21, there is arranged another spring arm 26 whose free end acts on a tongue 27 which partially closes off the duct 8 from the supply chamber 2. The direction of this arm 26 is chosen in such a way that, when the discharge opening is closed, the spring arm 26 bends the tongue 27 into the interior of the duct 8 and clamps the tablets which are in the duct. When the slide member 12 is moved into its other end position in which its opening 24 is in alignment with the discharge opening 11, the tongue 23 is moved into the interior of the duct 8 by means of the spring arm 22 and the second tablet lying in front of the discharge opening 11 is held at this position. By bringing the tablet dispenser in an inclined position, the first tablet can leave the duct 8.

While the tablet is dispensed, the spring arm 26 moves into the supply container or chamber 2, so that the tongue 27 is moved outwardly from the duct 8. The tablets which are in this duct can slide past the tongue 27 while the first tablet is dispensed until they reach the clamped tablet and, thus, they can form a secured supply in the duct 8.

After the dispensing procedure, the slide member 12 is released, so that, under the influence of the spring 21, it is moved into its initial position in which it closes off the discharge opening 11. Simultaneously, the clamping action on the second tablet is released. The arm 26 again presses the tongue 27 into the interior of the duct, so that those tablets which are in front or downstream of the tongue 27 in the duct 8 are prevented from sliding back. The spring arm 26 and the tongue 27 can also be replaced by a slide member which interacts with the slide member 12 and, for example, is actuated by a double lever and reaches between two adjacent tablets through a slot in the duct wall. If the tablets are not sensitive or fragile, the spring arm 26 may assume the separating function of the above-mentioned slide member.

The invention is not limited to the embodiment shown. For example, the slide member 12 can be guided in another manner and another type of spring can be used instead of the spring shown. Also, that wall portion which can be moved into the interior of the feed duct can be deformable by means other than the ones shown.

The essential feature is that, by the movement of that element which closes and releases the discharge opening, a clamping pressure acts on the second tablet or on one or several tablets which are further back in the discharge duct.

While a specific embodiment of the invention has been shown and described in detail to illustrate the application of the inventive principles, it will be understood that the invention may be embodied otherwise without departing from such principles.

I claim:

1. A tablet dispenser comprising: wall means defining a feed duct dimensioned to permit passage therethrough in a given direction of tablets to be dispensed by said tablet dispenser, said feed duct being defined with a discharge opening at one end thereof; slide means movable to open and close said discharge opening to enable selective dispensing of tablets therefrom; clamping means operable to prevent movement within said duct means in said given direction of tablets located beyond a predetermined distance upstream of said discharge opening, said clamping means comprising a portion of said wall means adapted to be displaced inwardly of said duct means; spring means operably engaged between said slide means and said portion of said wall means to effect displacement of said portion inwardly of said duct means when said slide means is moved to open said discharge opening; and holding means located along said duct means further upstream than said clamping means operable when said discharge opening is closed by said slide means to prevent within said duct means reverse movement of said tablets in a direction upstream of said given direction, said holding means being operably connected with said slide means for movement out of its effective position when said discharged opening is opened.

2. A dispenser according to claim 1 wherein said holding means comprise a clamping device.

3. A dispenser according to claim 1 wherein said holding means comprise another portion of said wall means located upstream of said clamping means and adapted to be displaced inwardly of said duct means, and wherein said slide means acts upon said another wall means portion through a spring arm.

4. A dispenser according to claim 1 wherein said spring means is operably engaged with each of said slide means, said clamping means and said holding means, said spring means operating to spring bias said slide means toward a position closing said discharge opening while simultaneously applying a spring biasing force to said holding means to move said holding means to its effective position, said spring means simultaneously acting, when said slide means is moved toward a position to open said discharge opening, to move said clamping means inwardly of said duct means and to release said holding means to allow movement thereof out of its effective position.

5. A tablet dispenser comprising: wall means defining a feed duct dimensioned to permit passage therethrough in a given direction of tablets to be dispensed by said tablet dispenser, said feed duct being defined with a discharge opening at one end thereof; slide means movable relative to said wall means to open and close said discharge opening of said feed duct defined by said wall means to enable selective dispensing of tablets therefrom; clamping means operable to prevent movement within said duct means in said given direction of tablets located beyond a predetermined distance upstream of said discharge opening, said clamping means being comprised of a portion of said wall means adapted to be displaced inwardly of said duct means; and spring means operably engaged between said slide means and said portion of said wall means comprising said clamping means to effect displacement of said portion inwardly of said duct means to actuate said clamping means to prevent movement of said tablets through said duct means past said clamping means toward said discharge opening when said slide means is moved to open said discharge openings; said wall means being structured separately from said slide means and being arranged to define said duct means at least between said opening and said clamping means with a fixed width dimension sized approximately equivalent to the width of a single tablet to be dispensed to pass said tablets between said clamping means and said opening in a single tablet row one behind the other.

6. A dispenser according to claim 5 wherein said predetermined distance beyond which said clamping means prevents movement of tablets is selected to be a distance equivalent to the size of a single tablet, said dispenser thereby operating to dispense one tablet at a time.

7. A dispenser according to claim 5 wherein said spring means applies to said slide means a spring force biasing said slide means toward a position to close said discharge opening.

* * * * *